US007937873B2

(12) United States Patent
Keng

(10) Patent No.: US 7,937,873 B2
(45) Date of Patent: May 10, 2011

(54) COLLAPSIBLE CARBINE STOCK WITH SPARE MAGAZINE STORAGE ENCLOSURE

(75) Inventor: Da Keng, Smyrna, GA (US)

(73) Assignee: Keng's Firearms Specialty, Inc., Atlanta, GA (US)

( * ) Notice: Subject to any disclaimer, the term of this patent is extended or adjusted under 35 U.S.C. 154(b) by 0 days.

(21) Appl. No.: 11/798,330

(22) Filed: May 11, 2007

(65) Prior Publication Data

US 2007/0261284 A1 Nov. 15, 2007

Related U.S. Application Data

(60) Provisional application No. 60/799,337, filed on May 11, 2006.

(51) Int. Cl.
*F41C 23/22* (2006.01)

(52) U.S. Cl. ..... 42/71.01

(58) Field of Classification Search ..... 42/71.01–73, 42/74, 75.01, 75.03, 85
See application file for complete search history.

(56) References Cited

U.S. PATENT DOCUMENTS

| | | | | | |
|---|---|---|---|---|---|
| 931,766 | A * | 8/1909 | Kennedy | 42/71.01 |
| 2,298,678 | A * | 10/1942 | Chase | 42/71.01 |
| 2,495,977 | A * | 1/1950 | Madsen | 42/71.01 |
| 2,605,033 | A * | 7/1952 | Terry | 224/0.5 |
| 2,763,951 | A * | 9/1956 | Harvey | 42/71.01 |
| 5,159,136 | A * | 10/1992 | Marsh | 42/71.01 |
| 5,225,613 | A * | 7/1993 | Claridge | 42/74 |
| 5,813,157 | A * | 9/1998 | Scott et al. | 42/71.01 |
| 6,651,371 | B2 * | 11/2003 | Fitzpatrick et al. | 42/72 |
| 6,829,855 | B2 * | 12/2004 | Seifert | 42/90 |
| 6,925,743 | B1 * | 8/2005 | DiGiovanna | 42/71.01 |
| 7,104,001 | B1 * | 9/2006 | Digiovanna | 42/71.01 |
| 7,162,822 | B1 * | 1/2007 | Heayn et al. | 42/73 |
| 7,398,616 | B1 * | 7/2008 | Weir | 42/73 |
| 2008/0190004 | A1 * | 8/2008 | Filicietti | 42/71.01 |

OTHER PUBLICATIONS

W02005/103598; Filicietti, Nov. 3, 2005.*

* cited by examiner

*Primary Examiner* — Michael Carone
*Assistant Examiner* — Reginald Tillman, Jr.
(74) *Attorney, Agent, or Firm* — Rodgers & Rodgers

(57) ABSTRACT

A collapsible buttstock which is adapted primarily for use with military and tactical carbines, is supported by an extension tube which is connectable to the receiver of a carbine on which the collapsible buttstock is to be mounted. A storage enclosure is formed in the body of the buttstock and is sized and dimensioned so that it can receive a clip or magazine, typically able to carry 20 rounds, that is usable with the carbine on which the collapsible buttstock is mounted. The enclosure is provided with an openable cover that is hingably attached to the buttstock body. An easily operable cover latch assembly is usable to secure the cover in a closed position while facilitating expeditious opening of the cover to afford access to the spare magazine storage enclosure.

15 Claims, 7 Drawing Sheets

COLLAPSIBLE CARBINE STOCK WITH SPARE MAGAZINE STORAGE ENCLOSURE

CROSS-REFERENCE TO RELATED APPLICATION

This U.S. utility patent application claims priority from U.S. provisional patent application No. 60/799,337, filed May 11, 2006, the entire disclosure of which is expressly incorporated herein by reference.

FIELD OF THE INVENTION

The present invention is directed generally to a collapsible carbine stock with a storage interior. More specifically, the present invention is directed to a collapsible carbine stock that is provided with a spare magazine storage enclosure. Most particularly, the subject invention is directed to a collapsible carbine stock with a spare magazine storage compartment having a closable cover. The carbine has a collapsible buttstock that can be positioned in a selected one of a plurality of positions to accommodate to the physical characteristics of the individual user. The buttstock has a storage compartment which is sized to accommodate a typical 20 round clip. The storage compartment in the collapsible buttstock is provided with a closable cover which may be at least partially transparent for easy visual confirmation that a filled spare clip is situated in the storage enclosure or compartment.

BACKGROUND OF THE INVENTION

Military service or tactical carbines, such as the CAR-15 or the M4 are generally well known. These carbines are provided in a generally standardized configuration which is intended to allow a soldier or another user to carry and to use the carbine in typically harsh field conditions. In its standard configuration, the military service or tactical carbine includes a buttstock that is supported by an extension tube which includes a buffer assembly recoil spring. The stock may be slidable, with respect to the body or receiver of the carbine, to accommodate to the diverse physical characteristics of the various military and para-military forces who tend to use such carbines. Other than its ability to collapse, the buttstock of the generally known military service and tactical carbines do not provide any storage capability.

In the M16 A2 or A1 stock, there is provided a small storage capacity. This is typically available for the storage of a cleaning rod which can be broken down into a plurality of sections, together with the customary cleaning attachments that one would expect to use with a cleaning rod. However, the standard buttstock of a military service or tactical carbine, such as the CAR-15 or M4 does not have such a storage cavity and thus cannot carry even the smallest of emergency supplies or a replacement clip of ammunition.

It is often imperative that spare magazines be readily available. In combat situations, a soldier may be cut-off from a source of supply of clips of ammunition. Various stop-gap solutions to the problem have been proposed but none has proven to be particularly acceptable. Spare magazines have been taped together, either side-by-side or end-to-end or have been secured together through the use of clumsy "duplex" clamping devices. Such make-shift arrangements are clumsy, not particularly secure and prone to fail under strenuous usage. In an effort to overcome the obvious limitations of these efforts to carry spare clips or magazines, the users of those previous military service or tactical carbines have attempted to attach spare clips or magazines using a variety of straps or slings. Such efforts are generally fruitless.

Spare magazines or clips are open at one end, so that the rounds can be stripped off the top and fed into the firing chamber. The only time that the open top of a clip or a magazine is not open is when the clip is actually loaded into the rifle or carbine. The spare clips or magazines are thus susceptible to entry of dirt and debris, particularly in combat or field environments. An attempt has been made to provide removable covers for such spare clips. However, if the cover is able to stay in place during the typical rough handling to which the clips or magazines are subjected, it is apt to be difficult to remove in a combat situation. Without such a cover, there is a potential for the dirt or debris which enters the clip to either jam the firing mechanism of the carbine or to cause other similar, potentially very dangerous malfunctions.

It will be readily apparent that a need exists for a collapsible buttstock, usable with a military service or tactical weapon, that overcomes the limitations of the prior art. The collapsible carbine stock, with a spare magazine storage enclosure, in accordance with the subject invention, overcomes the limitations of the prior art.

SUMMARY OF THE INVENTION

It is an object of the present invention to provide a collapsible carbine stock with a storage enclosure.

Another object of the present invention is to provide a collapsible carbine stock with a magazine storage compartment.

A further object of the present invention is to provide a collapsible carbine stock with a spare magazine storage enclosure that includes a securable cover.

Still another object of the present invention is to provide a collapsible carbine stock magazine storage compartment with a cover which is at least partially transparent.

Even yet a further object of the present invention is to provide a collapsible carbine stock with a spare magazine storage compartment that is durable and which will not adversely affect the strength of the collapsible stock.

As will be described in detail in the description of the preferred invention, which is set forth subsequently, the collapsible carbine stock with a spare magazine storage enclosure, in accordance with the present invention, is intended for use with a standard, magazine-fed military service or tactical carbine, such as CAR-15 or an M4. The collapsible stock of the present invention is adapted to engage a receiver of a generally well-known carbine and includes an extension tube assembly that is adapted to cooperate with a buffer assembly and a recoil spring to dampen recoil and to drive the carbine's bolt forwardly. The extension tube, in accordance with the subject invention, is provided with a flange or a key which is cooperatively receivable in a keyway or a channel in the hollow collapsible buttstock. That key or flange has several axially spaced, aligned through bores, each of which is sized to selectively receive a locking projection of a collapsible buttstock lock. The projection is receivable in a selected one of the axially spaced bores in the extension tube key or flange to facilitate a proper positioning of the collapsible buttstock to accommodate users of various sizes.

The collapsible buttstock in accordance with the present invention includes a hollow buttstock body that provides a compartment or enclosure which is sized to receive and to store a 20 round clip or magazine. The buttstock includes the extension tube, which will receive a buffer assembly and a recoil spring, which extension tube is adapted for connection with a typical carbine's receiver. The buttstock body also has an upper comb surface, with a selected check rest height. The hollow interior of the buttstock body, defines a cavity, compartment or enclosure which is sufficiently large to receive a standard twenty (20) round magazine. The enclosure, compartment or hollow space, in the interior of the carbine buttstock, is provided with a removable, hinged cover that can be locked in a closed position. When it is unlatched, and opened, the cover will provide unrestricted access to the magazine enclosure or compartment. As the door is opened, the magazine or clip is exposed so that it can be easily grasped for removal and use. The cover for the compartment may be either partially or completely transparent so that visual verification of the presence of a clip or magazine in the enclosure, and its being provided with rounds, is easily accomplished.

The collapsible carbine stock with the spare magazine storage enclosure in accordance with the present invention has very little adverse weight impact on the overall carbine. The buttstock is made of lightweight, durable materials and is structured to engage the conventional extension tube receiving fitting of the carbine's receiver. It is essentially the same, in overall configuration, as the conventional, collapsible buttstock that carbines, such as the M4, are typically supplied with.

A planar butt plate is carried on the buttstock and is positioned so that it will engage the shoulder of a user of the carbine, in a generally conventional manner. That butt plate has an aperture which is configured cooperatively with the extension tube receiving passage in the buttstock, and includes the same shape of the keyway as is a part of that extension tube receiving passage. When the collapsible buttstock is in its fully collapsed position, the distal end of the extension tube is situated in the aperture in the butt plate. That positioning will impart additional structural rigidity to the buttstock assembly which, as is known to those familiar with these weapons, is often called upon to perform tasks other than engaging the shoulder of the carbine's user.

The extendible or collapsible buttstock of the present invention is positionable in a plurality of positions which correspond to a length of pull of the carbine's user. A collapsible buttstock lock extends transversely through the collapsible buttstock and has a locking projection at one end. That locking projection is selectively receivable in one of a plurality of cooperatively shaped bores which are spaced axially along the key that depends downwardly from the extension tube. On its end opposite to the locking projection, the collapsible buttstock lock carries a depressible locking button. The locking pin is biased to its locked position by a spring that is acting against an inner surface of the locking button. Actuation of the spring-biased collapsible buttstock lock, during adjustment of the length of pull of the collapsible buttstock is familiar to users of these types of carbines. That action is essentially the same as one which is utilized to release a magazine or clip from the receiver portion of the carbine.

In a service carbine, such as the M4, the magazine is held in place by a spring-biased lock. When a user of the carbine inserts a magazine into the operative position in the magazine well, the spring-actuated lock holds it in place. To release the lock mechanism that holds the magazine in the magazine well, the carbine's user depresses a button to overcome the spring force of the magazine lock. To vary the length of pull of the collapsible buttstock, the user depresses a button against a spring force. Thus the provision of a spring-biased collapsible buttstock lock, for use in adjustment of the position of the collapsible buttstock of the subject invention provides a continuity of operation that will be familiar to the carbine's user.

A spare magazine can be positioned within the pocket or receptacle in the collapsible buttstock and is retained in place by the provision of a hinged door that is secured by a latch mechanism including first and second spring biased opposing latch pins. The opposing latch pins engage axially aligned pin receiving blind bores formed in the buttstock's body, to thus keep the hinged door closed. The latch mechanism also includes first and second transverse latch pin retraction levers each of which is provided with a contoured retraction lever button. Each of the opposing latch pins is rigidly connected to one of the transverse retraction levers which, in turn, each projects laterally to the exterior of the stock's door, so the contoured retraction lever buttons are situated side by side on the exterior of the buttstock. The buttstock's door includes co-linear spaced slots which are approximately one inch apart. Each slot has a length of approximately one quarter inch, and the latch mechanism's transverse latch pin retraction levers each pass through one of the slots. The contoured retraction lever button is carried on the distal transverse end of each such retraction lever in an orientation allowing the user to actuate the latch mechanism with one hand by urging the two spaced, contoured retraction lever buttons together, thereby compressing the latch mechanism's biasing spring and concurrently retracting the latch mechanism's opposing pins. The hinged door can then open, uncovering the magazine storage pocket.

The collapsible carbine stock with a spare magazine storage enclosure, in accordance with the present invention, is, as was alluded to previously, strong, durable and able to withstand the rugged use to which it is likely to be subjected in typical military operations. It will withstand such rough usage as well as do conventional buttstocks, such rough usage extending to, but not limited to use of the buttstock as a battering ram, a pry bar, a defensive weapon and the like. The buttstock itself is preferably made of a fiber reinforced material commonly known as "PA66". The door or cover can be made from this material as well or can be a transparent resin or the like. The extension tube is preferably made of steel or aluminum and carries a generally well-known standard buffer assembly and recoil spring inside. The various fillings will preferably be fabricated of high strength, non-corrosive materials.

The collapsible carbine stock with spare magazine storage compartment, in accordance with the present invention, is a substantial advance over the prior art. It provides a collapsible buttstock, with a magazine storage compartment that has previously not been available. It is far superior to the presently available buttstocks.

BRIEF DESCRIPTION OF THE DRAWINGS

A full and complete understanding of the collapsible carbine stock with a spare magazine storage enclosure, in accordance with the present invention, may be had by referring to the detailed description of the preferred embodiment, as set forth subsequently, and as illustrated in the accompanying drawings, in which.

DESCRIPTION OF THE PREFERRED EMBODIMENT

Figure 1:
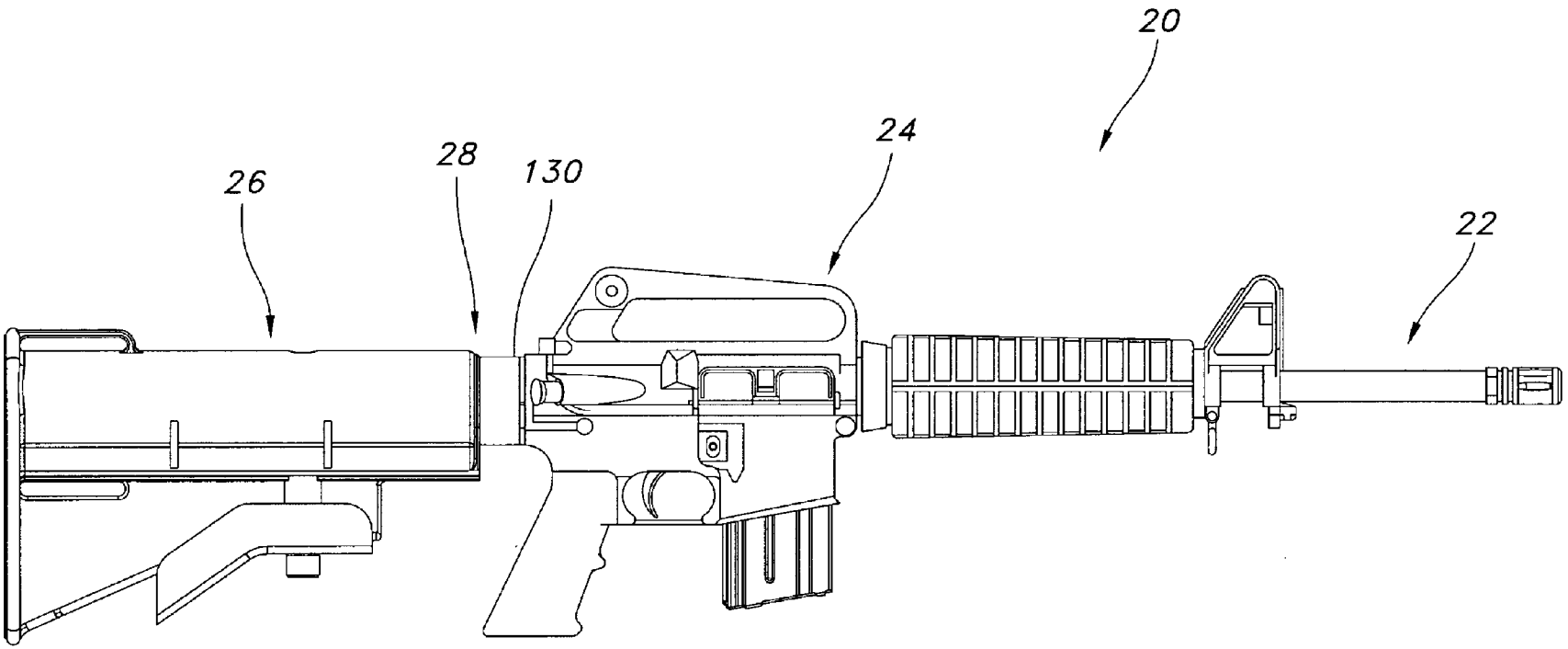
FIG. 1 (PRIOR ART)
FIG. 1 is a schematic side elevation view of a generally conventional carbine.

Referring initially to FIG. 1, there may be seen, generally at 20 a schematic depiction of a conventional M4 carbine with which the collapsible buttstock with a spare magazine storage enclosure, in accordance with the present invention, find use. The carbine 20 includes a barrel 22, a receiver 24 and a shoulder engageable stock 26. As is generally conventional, the stock 26 is attached to the receiver 24 by an extension tube 28 that includes a buffer assembly and a recoil spring which is not clearly visible in FIG. 1. The buffer assembly and recoil spring are well known generally and are utilized to absorb recoil, and to provide a source of power for the automatic or semi-automatic operation of the carbine, generally at 20. It will be understood that the collapsible buttstock with a spare magazine storage compartment, in accordance with the present invention, is intended to be usable with a carbine, such as the M4 carbine depicted in FIG. 1. It will however also be understood that the collapsible buttstock with a spare magazine storage compartment, in accordance with the present invention, is also usable with other generally similar carbines and rifles, specifically those carbines and/or rifles that have an extension tube including a buffer assembly and a recoil spring.

Figure 2:
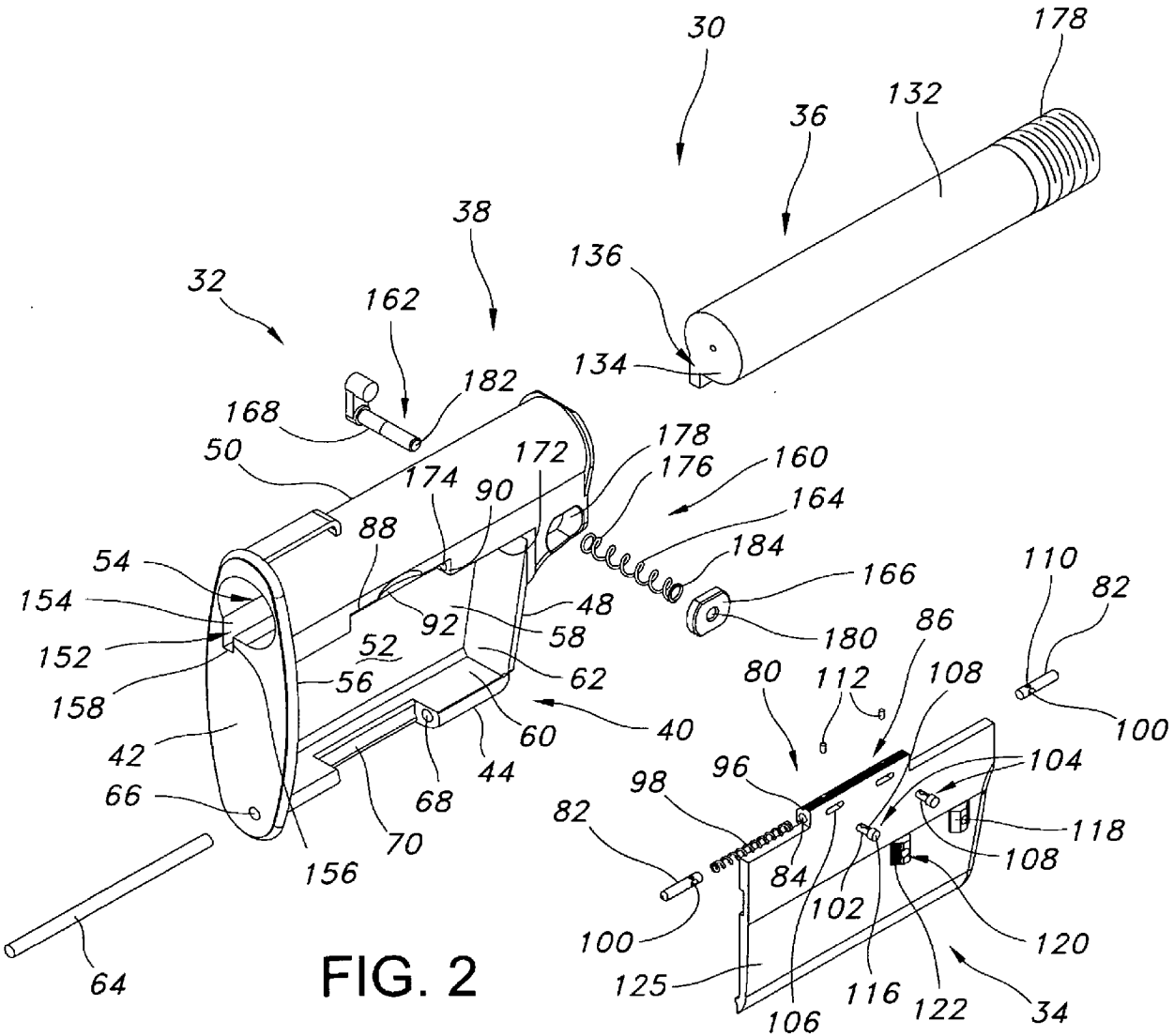
FIG. 2 is an exploded perspective view of a collapsible buttstock in accordance with the present invention.

Turning now to FIG. 2, there may be seen generally at 30 a preferred embodiment of a collapsible buttstock with a spare magazine storage compartment in accordance with the present invention. The collapsible buttstock assembly 30 of the present invention includes a compartmented buttstock 32, a cover door 34 for the compartmented buttstock 32, an extension tube 36 on which the buttstock 32 is slidable between a collapsed position and a plurality of selectively adjustable pull length positions and a collapsible buttstock lock assembly, generally at 38 which functions, in a manner that will be described in detail shortly, to facilitate the deployment of the buttstock 32 between a collapsed position, similar to the one depicted for the stock 26 in FIG. 1; i.e. with the stock 32 adjacent to the receiver 24, and a fully extended portion, which is not specifically depicted but is one in which the length of pull has been maximized by increasing the separation between the buttstock 32 and the receiver 24 to the extent possible, while still supporting the stock on the extension tube.

Figure 7:
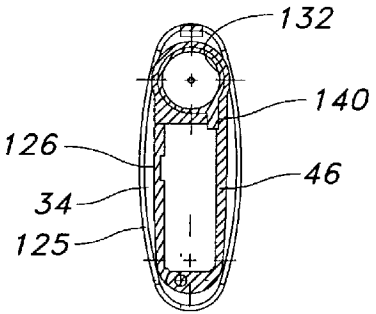
FIG. 7 is a cross-sectional view of the buttstock of FIG. 5 taken along line VII-VII of FIG. 5.
Figure 6:
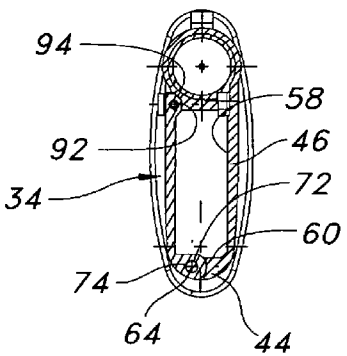
FIG. 6 is a cross-sectional view of the buttstock of FIG. 5, taken along line VI-VI of FIG. 5.
Figure 11:
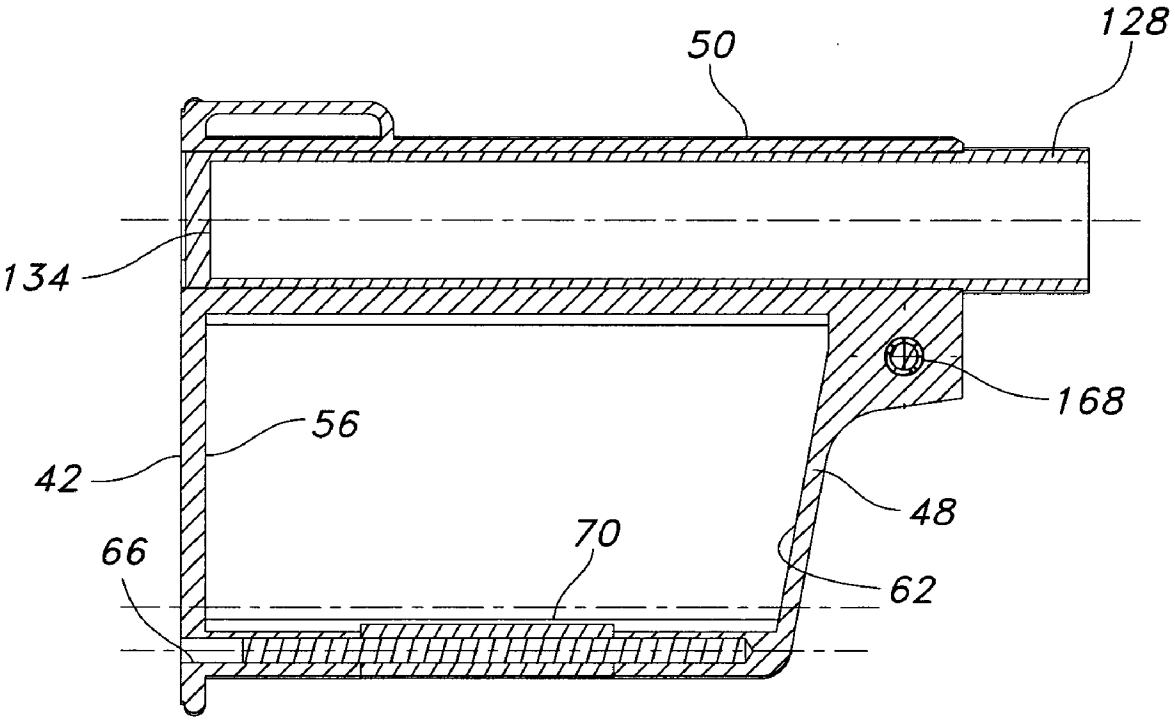
FIG. 11 is a cross-sectional view of the collapsible buttstock and taken along line XI-XI of FIG. 10.
Figure 10:
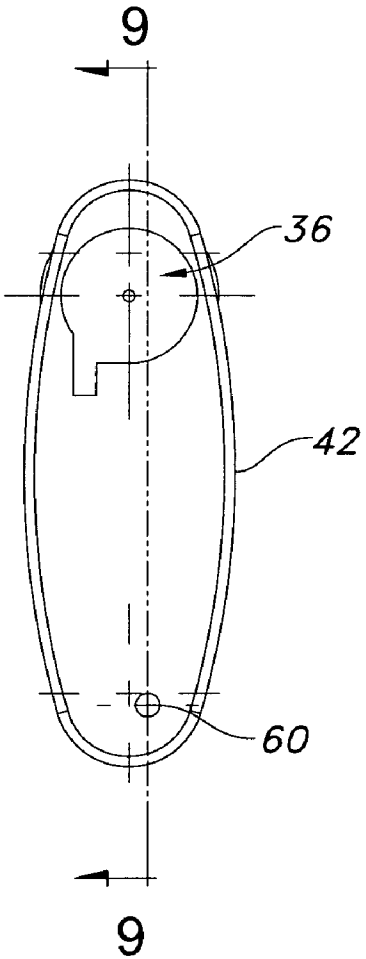
FIG. 10 is a rear elevation view of the collapsible buttstock of the present invention.

As may be seen in FIG. 2, the buttstock 32 is generally rectangular and includes a stock body 40 which is provided with a distal butt plate 42. Butt plate 42 is generally planar although it may be slightly concave so that it will more comfortably engage a shoulder area of a person using a carbine or rifle that is equipped with the collapsible buttstock 30 of the present invention. The stock body 40 includes a bottom 44, a sidewall 46, as seen in FIGS. 6 and 7, a forward wall 48, as seen in FIG. 11, and an upper comb surface 50, which is generally arcuate, and which provides a check rest height. These several components of the stock body 40 cooperate to define a stock enclosure or receptacle, generally at 52. A generally cylindrical extension tube receiving passage or bore 54, which will be discussed in greater detail subsequently, overlies the stock enclosure 52 and is situated on the stock body 40 beneath the upper comb surface 50, as may be seen in FIG. 2.

The stock enclosure 52 is generally rectangular and is sized to occupy the bulk of the interior volume of the stock body 40. Enclosure 52 is defined by an inner surface 56 of the butt plate 42, by an inner surface 58 of the stock body sidewall 46, by an upper surface 60 of the stock body bottom 44 and by an inner surface 62 of the stock body forward wall 48. Since the primary purpose of the stock enclosure 58 is to receive a spare magazine or clip, typically one that carries 20 rounds, for use in the carbine of which the collapsible buttstock 32 in accordance with the present invention is intended to be used, it will be readily apparent that the overall size of the stock body 40 must be sufficiently large to have an enclosure 52 that will accept a replacement or spare 20 round clip or magazine. Referring again to FIG. 1, a standard M4 carbine is illustrated, including its standard detachable box magazine. As will be appreciated by those having skill in the art, the clip or magazine illustrated in FIG. 1 is a standard 20 round detachable box magazine now in use among NATO forces, in accordance with NATO standard STANAG 4179; this magazine is also characterized as an "M16 style" detachable box magazine, and in the illustrated example of FIG. 1, carries twenty rounds of 5.56 NATO ammunition, the standard ammunition for an M4 carbine. Stock enclosure 52 is dimensioned to receive a spare or replacement magazine such as the detachable box magazine illustrated in FIG. 1 and described in NATO standard STANAG 4179.

The stock enclosure 52 is generally rectangular, as depicted in FIG. 2. As discussed above, its size or volume must be sufficient to receive a spare or replacement clip or magazine for use with the carbine 20 to which the collapsible buttstock 30 of the present invention is to be attached. The representation of FIG. 2 is to be understood to be illustrative of various overall shapes and appearances of the buttstock 32. For example, the rear butt plate 42 is depicted as being generally planar with an overall ovoid shape. The butt plate 42 could be suitably contoured to enhance its compatible engagement with the shoulder of the user. The upper comb surface 50 is depicted as being a plain arcuate surface. It could be configured with an exterior contour or a pattern of checking or inletting that would make the comb surface more amendable to being engaged by the user's cheek. Similarly, the forward wall 48 of the stock body 40 could be provided with a surface contour that would facilitate grasping by the user. All of these surface embellishments and contours are not specifically depicted in the drawings of the subject invention. However, that is not to be construed as an indication that such elements are not available.

Figure 15:
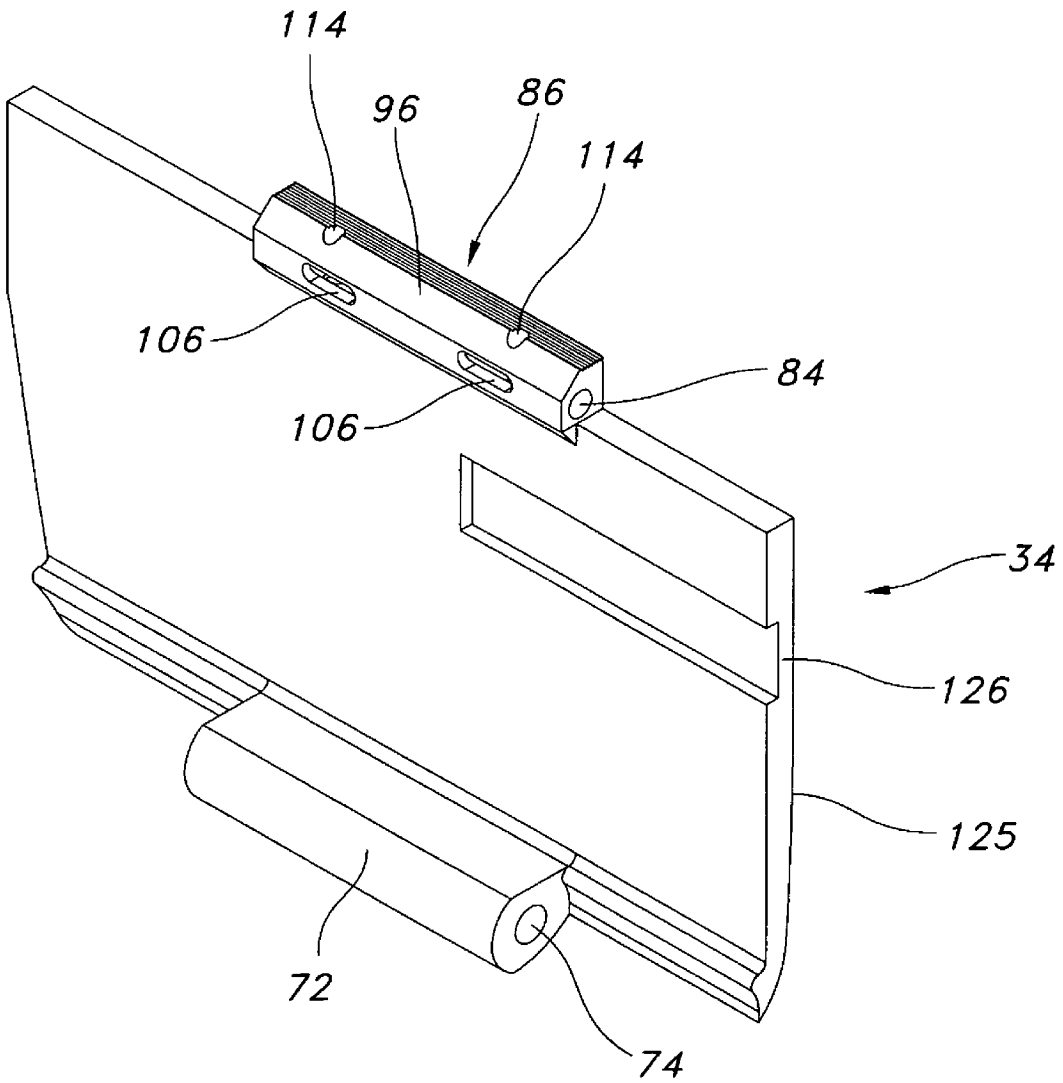
FIG. 15 is a rear perspective view of the cover door in accordance with the present invention.

The spare magazine receiving stock enclosure 52 is provided with a cover door, generally at 34, as seen in FIG. 2. Cover door 34 has an overall shape that will complement the shape of the opening into the stock enclosure 52. As depicted in FIG. 2, that overall shape of the cover door 34 is preferably generally rectangular. The cover door 34 is mounted in the stock body by a hinge mechanism that includes a hinge pin 64 which is receivable in a bore 66 in the butt plate 42 and which is aligned with a blind bore 68 in the stock body bottom 44. A generally rectangular notch 70 is provided in the stock body bottom 44. That notch 70 is sized to receive a hinge sleeve 72 which is formed on an inner lower surface of the cover door 34, as may be seen in FIGS. 6 and 15. In use, the cover door 34 is placed in the buttstock enclosure 52 and is positioned so that a through bore 74 in the hinge sleeve 72 is aligned with the blind bores 66 in the stock body bottom 44. The hinge pin 64 is then inserted into the aligned hinge sleeve through bore 74 and the stock body bottom blind bores 66. If desired, an end of the hinge pin 64 and the butt plate bore 66 could be cooperatively threaded to retain the hinge pin 64 in place in the stock body 40. The cover door 34 is now free to move between the open position depicted in FIG. 3 and the closed position depicted in FIG. 4.

Figure 4:
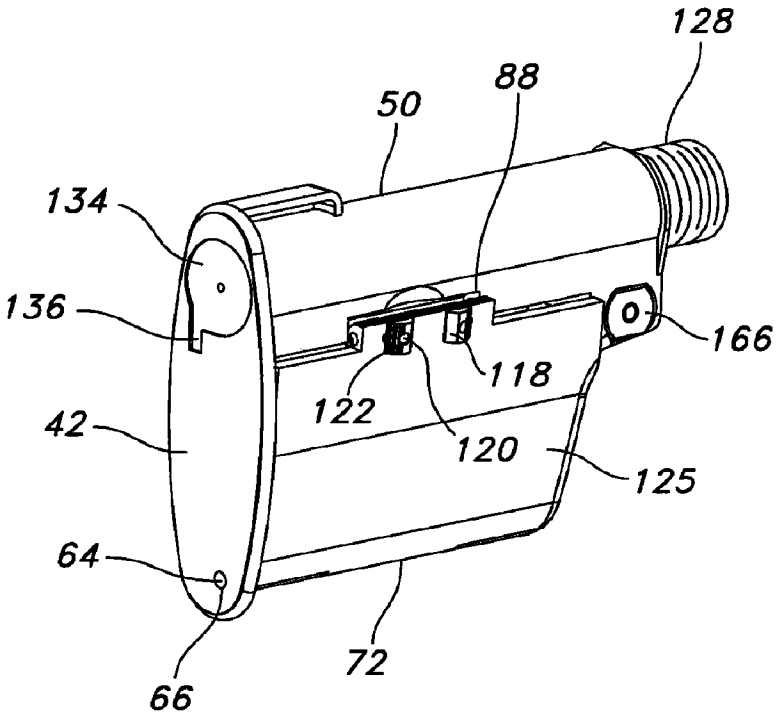
FIG. 4 is a perspective view, generally similar to FIG. 3, and showing the collapsible buttstock with the magazine enclosure door closed.
Figure 3:
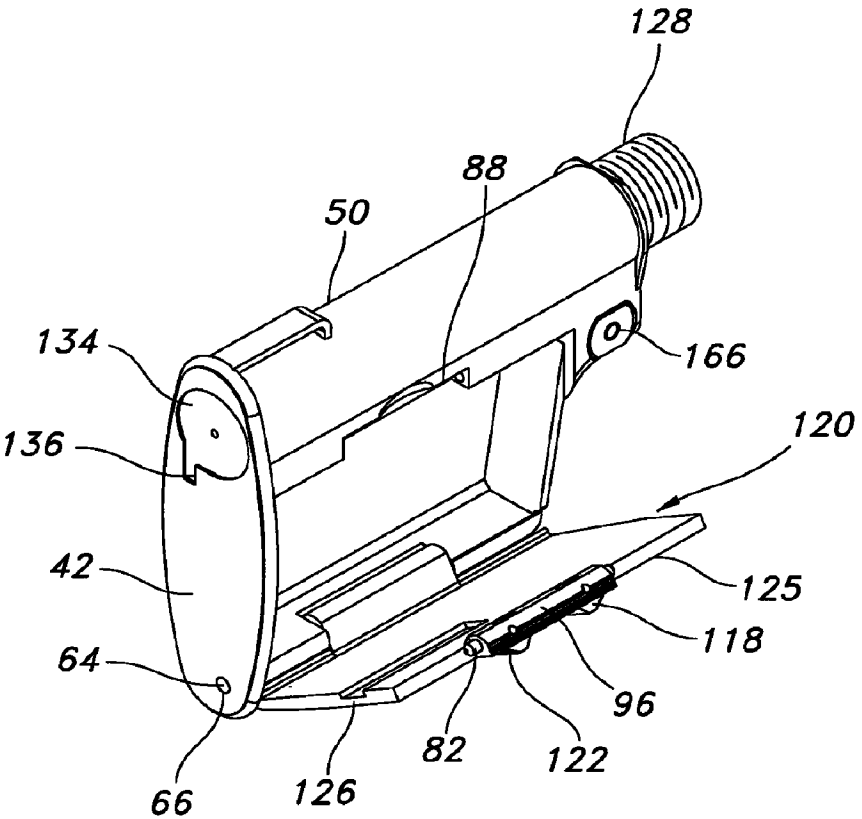
FIG. 3 is a perspective view of an assembled buttstock of the present invention, with the magazine enclosure door open and supporting a clip or magazine.

A cover latch assembly is provided on the cover door and is indicated generally at 80 in FIG. 2. A pair of latch pins 82 are slidable in a latch pin passage 84 which is formed on a cover door latch tongue 86. When the cover door 34 is attached to the buttstock body 40 by the hinge pin 64, and the cover door 34 is placed into its closed position, the latch tongue 86 will be situated in a cooperatively shaped latch groove 88, as seen in FIGS. 2, 3 and 4. The latch groove includes latch groove side walls 90, a latch groove back wall 92 and a latch groove top wall 94. As seen in FIG. 6, that latch groove top wall 94 is inclined or beveled and is complementary in shape to that of a latch tongue top wall 96, which is seen most clearly in FIG. 15.

Returning to FIG. 2, the two axially aligned cover door latch pins 82 are positionable in the cover door latch pin passage 86. A cover door coil spring 98 is interposed between these two cover door latch pins 82. If not retrained, the two cover door latch pins 82 would be forced out of the cover door latch pin passage 84 by the spring bias imparted to them by the cover door latch pin coil spring 98. As seen in FIG. 2, each latch pin 82 has a transverse pin bore 100 at its inner end. These transverse pin bores 100 are sized to receive shanks 102 of latch pin retraction levers 104. Each of these latch pin retraction levers 104 is slidable in a corresponding retraction lever slot 106 that is formed in the cover door latch tongue 86. The two slots 106 extend in the axial direction of the latch pin passage 86. Each of the latch pin retraction levers 104 has a transverse bore 108 which is preferably internally threaded. When the latch pins 82 are slid into the opposite ends of the latch pin passage 86, sandwiching the latch pin coil spring 98, they will be held in place by insertion of the retraction lever shanks through the slots 106 and into the transverse bores 100 at the inboard ends of the two latch pins 82. The inboard ends of the two latch pins 82 also have threaded bores 110 that are essentially transverse to the retraction lever shank receiving bores 100, also formed in the inboard ends of the latch pins 82. A pair of set screws 112 are inserted through access bores 114 in the cover door latch tongue 86. These set screws 112 are screwed into the threaded retraction lever bores 108 and into the threaded latch pin bores 110, which are brought into alignment with each other. Now, the two latch pins 82 can be slid axially in opposition to each other by pinching the two latch pin retractor levers 104 between the user's thumb and forefinger.

Each of the latch pin retraction levers has an enlarged head 116. These heads are sized so that they will not fit into the two retraction lever slots 106. To aid in the grasping and manipulation of the latch pin retraction levers 104, each retraction lever head 116 may be provided with a retraction pin button 118. These buttons 118 have central apertures 120 which are sized to fit over the enlarged heads 116 of the retraction levers 104. Each such button 118 is preferably provided with a grip enhancing surface 122. That surface can be a knurled or crosshatched or grooved surface.

As is also depicted in FIG. 2, the latch groove side walls 90 are provided with latch pin receiving blind bores 124. Once the cover door 34 has been secured in place in the opening of the buttstock enclosure 52, by insertion of the hinge pin 64 through the aligned buttstock body bottom bores 68 and through the also aligned bore 74 in the cover door hinge sleeve 72, the previously assembled cover door latch assembly 80 will be operable to hold the cover door 34 in its closed position. The two blind bores 124 in the side walls 90 of the cover door tongue receiving grooves 88 are located so that when the latch pins 82 extend out of the cover door tongue 86, under the force exerted on them by the latch pin coil spring 98, a front face 125 of the cover door 34 will be flush with the side of the buttstock body 40.

As is known in the art a generally conventional 20 cartridge magazine or clip 120, as seen in FIG. 3, has a specific size. The interior volume of the buttstock enclosure 52, and the dimensions of the enclosure opening and of the cover door 34 are such that the 20 cartridge magazine 120 can be placed into, and removed from the buttstock enclosure 52. It is generally conventional to provide a view slot in the cartridge magazine. That view slot is provided so that the number of cartridges positioned in the clip 120 can be readily ascertained. As may be seen in FIG. 15, the cover door 34 may be provided with a transport view window 126, that may be in the form of an insert in the body of the cover door 34, or that could be molded integrally with the cover door. Alternately, the entire cover door 34 could be made of a transport material so that the presence of absence of a magazine or clip 120 could be readily verified, and so that the presence of cartridges in the magazine 120 could also be verified. The cover door view window 126 will be situated in the cover door 34 so that it will align with the view slot which is typically provided in a cartridge magazine 120.

The collapsible carbine buttstock with a spare magazine storage enclosure, in accordance with the present invention includes the extension tube, generally at 36, as seen in FIG. 2. This extension tube is generally conventional, with respect to its primary purpose of supporting a buffer assembly and a recoil spring which are used to dampen the recoil of the weapon and to provide the force required to strip and eject a spent casing and to chamber a fresh round. The structure and function of the buffer assembly and of the recoil spring are well-known in the art, and do not form any part of the subject invention. As will be understood by those of skill in the art, the extension tube, generally at 36 in accordance with the present invention includes a threaded end 128, which is preferably externally threaded and is adapted to be threaded into a mil-spec, internally threaded fitting, generally at 130 in FIG. 1 which is situated at the rear of the receiver 24 of the M4 carbine depicted generally at 20 in FIG. 1.

Figure 12:
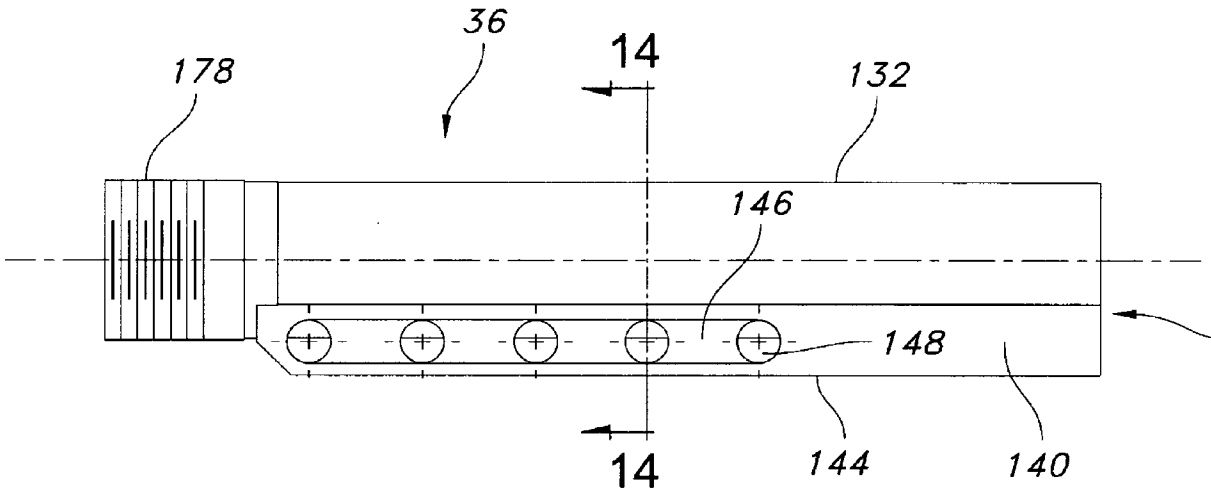
FIG. 12 is a side elevation view of the extension tube in accordance with the present invention.
Figure 13:
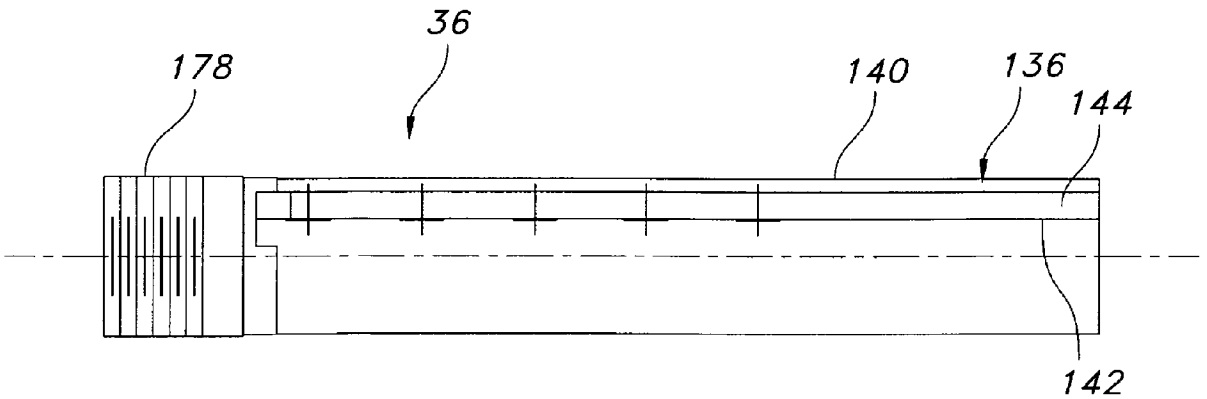
FIG. 13 is a bottom plan view of the extension tube.
Figure 14:
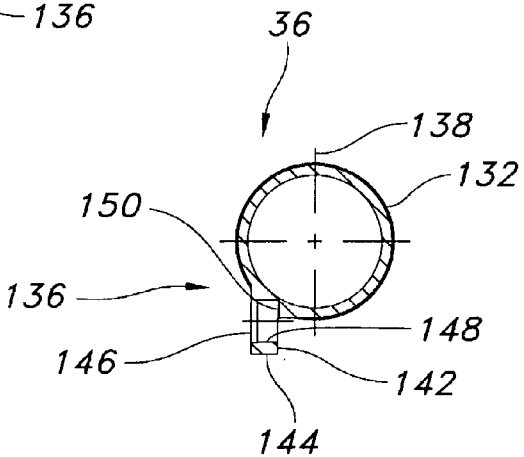
FIG. 14 is a cross-sectional view of the extension tube of the present invention and taken along line XIV-XIV of FIG. 12.

Returning to FIG. 2, the extension tube, generally at 36 has a cylindrically shaped extension tube body 132 which extends from the threaded end 128 to a closed end wall 134 at the opposite end of the tube body 132. A flange, generally at 136 depends from the extension tube body 132 and is arranged offset laterally from a vertical center line 138 of the extension tube body 132, as may be seen in FIG. 14. The extension tube flange 136 is aligned with an axial length of the extension tube body 132 and is not tangent with the extension tube body 132, all as may be seen in FIG. 14. Flange 136 has a flange outer wall 140, a flange inner wall 142 and a flange bottom wall 144. As may be seen in detail in FIGS. 12, 13 and 14, the extension tube flange outer wall 140 includes a flange outer wall recess 146 which is formed with a plurality of axially spaced through bores 148. As depicted in FIG. 12, there may be provided five such flange through bores 148. These through bores 148 each has an inner abutment wall 150 that is defined by a portion of the hollow body 132 of the extension tube. The purpose and function of these extension tube flange through bores 148, as well as the purpose and function of the extension tube body 132 and its flange 136 will now be discussed in detail.

The buttstock body 40 is slidably or collapsibly supported on the extension tube, generally at 36. As mentioned previously, the buttstock 40 includes an extension tube receiving passage or bore, generally at 54. That bore has an overall configuration which is complementary to that of the overall shape of the extension tube 32. The buttstock body extension tube receiving passage is generally cylindrical and includes a downwardly depending keyway 152. That keyway 152 is defined by a keyway outer wall 154, a keyway inner wall 156 and a keyway bottom wall 158. The three keyway walls are complementary, in size and in shape, to the extension tube flange 136 which thus forms a key which is receivable in the keyway 152. The buttstock body 40 is thus free to slide axially along the extension tube, onto which it is inserted. It is typically not rotatable with respect to the extension tube.

Quite clearly, the buttstock body 40 cannot slide freely on the extension tube 36 during use of the carbine 20. It is receivable in a selected one of a plurality of positions that can be selected in accordance with the physical characteristics of the user; i.e. the user's so-called pull length. Referring now initially to FIG. 2, the collapsible stock in accordance with the present invention includes a collapsible buttstock lock assembly, generally at 160. This collapsible buttstock lock assembly, generally at 160, includes a transversely slidable buttstock lock bolt, generally at 162, a lock bolt biasing coil spring 164 and a collapsible buttstock lock release button 166.

Figure 8:
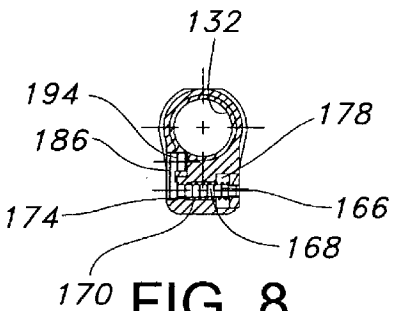
FIG. 8 is a cross-sectional view of the buttstock of FIG. 5 and taken along line VIII-VIII of FIG. 5.

The slidable lock bolt 162 has a slide shank 168 which, as may be seen in FIG. 8, is receivable in a transverse bore 170 that extends across the buttstock body 40 adjacent a juncture of the buttstock body forward wall 48 and an upper interior surface 172 of the buttstock magazine receiving enclosure 52. As may be seen in FIG. 8, that transverse bore 170 has an inner shoulder 174 which acts as an abutment surface for a first end 176 of the biasing spring 164. A button receiving recess 178 is formed in the buttstock body 40 and is concentric with the transverse bore 170. It will be understood that the button receiving recess 178 is dimensioned to slidably receive the release button 166. Preferably, that release button 166 has a central aperture 180 which is sized to receive a free end 182 of the bolt slide shank 168. A second end 184 of the coil spring 164 abuts an inner surface of the button 166 to bias the slidable lock bolt to a locked portion, as will now be discussed.

Figure 9:
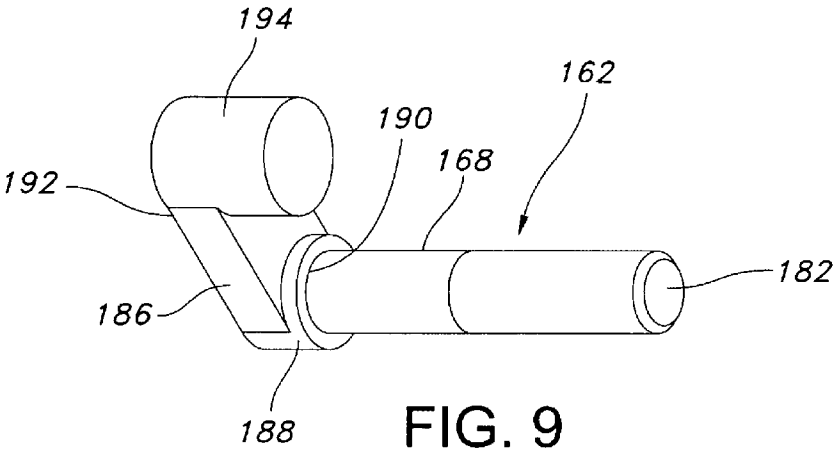
FIG. 9 is an enlarged perspective view of the collapsible buttstock lock of the present invention.
Figure 5:
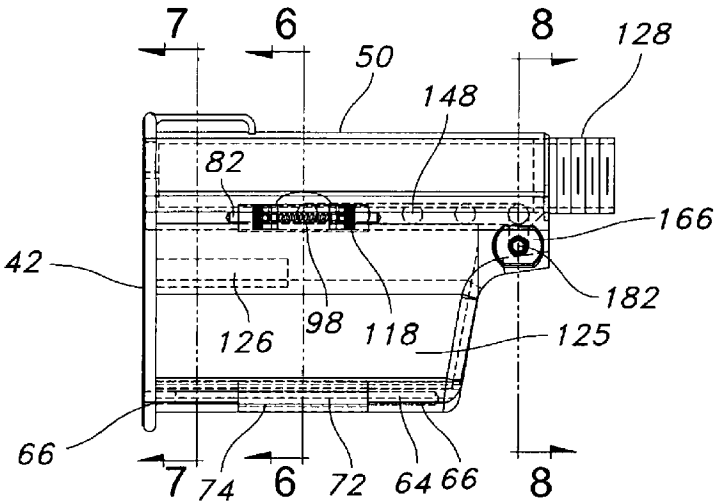
FIG. 5 is a side elevation view of the collapsible buttstock.

The slidable lock bolt 162 is depicted most clearly in FIG. 9. It includes the bolt slide shank 168, with its free end 182, as has been described above. At an end of the bolt slide shank 168, opposite to the free end 182, the slidable lock bolt, generally at 162, is provided with a lock arm 186. That lock arm 186 is attached, at a first end 188 to a second end 190 of the bolt slide shank 168. At its second end 192, the lock arm 186 is provided with a locking projection 194. The locking projection is depicted as being generally cylindrical. It is sized to be receivable in a selected one of the several axially spaced flange through bores 148 which are distributed axially spaced along the flange outer wall 140 of the flange 136 of the extension tube 36.

Once the threaded end 128 of the extension tube 36 has been screwed into the milspec fitting 130, which is a part of the receiver 24 of the carbine, generally at 20, the collapsible buttstock body 40 can be slid onto the extension tube 36. The key or flange 136 of the extension tube body 132 is received in the keyway 152 of the extension tube receiving passage 54 in the buttstock body 40. During this process, the release button 166 is pushed into its cooperatively shaped button receiving recess 178 to slide the slidable lock bolt 162 to the left, as seen in FIGS. 2 and 8. The length of travel of the slidable lock bolt 162 is sufficient to allow the extension tube flange 136 to slide past the arm 186 and the locking projection 194 of the collapsible buttstock lock assembly 160. Once the buttstock body 40 is positioned on the extension tube 36, it can be slid along the tube 36 until it is positioned so that one of the axially spaced flange through bores 148 is aligned with the locking projection 194 of the slidable lock bolt 162. If desired, the locking button 166 can be released once the buttstock body 40 has been slid onto the extension tube 36. The locking projection 194 of the collapsible buttstock lock assembly will slide along the flange outer wall 140 until it drops into one of the axially spaced flange through bores 148. If that position of the buttstock body 40 is not comfortable to the user, he can depress the button 166 to unseat the projection 194 out of a first through bore 148 and can slide the buttstock body 40 along the extension tube 36 until the projection 194 is aligned with a different one of the several spaced flange through bores 148. It will be noted, as may be seen in FIGS. 8, 12 and 14 that the inner abutment wall 150 of each of the through bores 148 will limit the amount of travel of the projection 194 into each of the through bores 148. By proper dimensioning of the depths of the through bores 148, the length of the bolt slide shank 168 and the length of the locking projection 194 it will be assured that, as depicted in FIG. 8, the exterior of the buttstock body 40 does not have any projections or protrusions which could cause the collapsible buttstock in accordance with the present invention to catch on the user's apparel or on other objects. A smooth overall profile of the collapsible buttstock in accordance with the present invention is thus assured.

The collapsible carbine stock with a spare magazine storage enclosure, in accordance with the present invention, provides all of the positive attributes of a generally conventional collapsible buttstock. It also provides a magazine or clip storage compartment or enclosure that is not available in the presently available carbine buttstocks. The spare magazine storage enclosure of the collapsible buttstock of the present invention is readily accessed by the carbine's user, is sufficiently rugged and durable to withstand the typical rough usage that a military or tactical weapon is expected to encounter, and is provided with a cover that can be quickly opened to provide rapid access to the spare magazine which may be situated in the collapsible buttstock. The collapsible buttstock lock assembly of the collapsible carbine buttstock in accordance with the present invention, is robust, is easy to actuate, does not provide any surface that would create a snagging hazard and is generally much more satisfactory, in use, than are the prior collapsible buttstock assemblies.

While a preferred embodiment of a collapsible carbine stock with a spare magazine storage enclosure, in accordance with the present invention, has been set forth fully and completely hereinabove, it will be apparent to one of skill in the art that various changes in, for example, the specific materials used for the buttstock, the particular carbine which it is adapted to be used with, the particular structure of the clip or magazine that can be inserted into the buttstock enclosure, and the like could be made without departing from the true spirit and scope of the present invention, which his accordingly to be limited only by the following claims.

What is claimed is:

1. A buttstock for a carbine comprising: a buttstock body; a magazine receiving enclosure in said buttstock body; said buttstock body including a distal butt, and a first sidewall projecting proximally from said butt and bounded by an upper comb surface which opposes a bottom; a cover for said enclosure and supported on said buttstock body for movement between open and closed positions; a cover latch assembly for said cover; means for mounting said buttstock on a receiver of the carbine, said cover latch assembly including at least one slidable latch pin supported in said cover; a latch groove formed in said buttstock body, said latch groove comprising a pair of opposed side walls, at least one latch pin receiving blind bore extending from one of said latch groove side walls into said buttstock body; and at least one latch pin retraction lever engageable with said at least one slidable latch pin and adapted to slide said latch pin into said at least one latch pin receiving blind bore and out of said at least one latch pin receiving blind bore in opposition to a biasing force imposed by a biasing spring positioned in said cover.

2. The buttstock of claim 1 wherein said enclosure is generally rectangular and is sized to receive a twenty round magazine.

3. The buttstock of claim 1 wherein said buttstock body supports a hinge pin that is interposed between said buttstock body and said cover.

4. The buttstock of claim 1 wherein a latch tongue is formed on said cover and is adapted to receive said latch pin, and said latch tongue is situated in said latch groove.

5. The buttstock of claim 1 wherein said latch groove comprises a back wall, said latch tongue comprises a top wall, and said back wall and said top wall are complementary in shape.

6. The buttstock of claim 1 wherein a pin bore is formed in said latch pin and said retraction lever is receivable in said pin bore.

7. A buttstock of claim 6 wherein a first threaded bore is formed in said retraction lever, a second threaded bore is formed in said latch pin, and a set screw is screwed into said first and second bores.

8. The buttstock of claim 1 wherein an extension tube is securable to said carbine.

9. The collapsible carbine stock of claim 8 further including an extension tube receiving passage in said buttstock body, said extension tube receiving passage having a keyway, and a key on said extension tube.

10. The collapsible carbine stock of claim 9 wherein said extension tube key is an axially extending flange.

11. The collapsible carbine stock of claim 10 including a plurality of axially spaced flange through bores in said flange and further including a collapsible buttstock lock assembly in said buttstock body.

12. The collapsible carbine stock of claim 11 wherein said collapsible buttstock lock assembly includes a transversely slidable lock bolt, said slidable lock bolt having a locking projection at a first end and being receivable in a slidable one of said plurality of axially spaced flange through bores.

13. The collapsible carbine stock of claim 12 further including a collapsible buttstock locking assembly release button on a second end of said slidable lock bolt.

14. The collapsible carbine stock of claim 12 further including a biasing spring usable to bias said locking projection into said selectable one of said plurality of axially spaced flange through bores.

15. The collapsible carbine stock of claim 13 further including a release button receiving recess in said buttstock body and adapted to receive said collapsible buttstock locking assembly release button.

* * * * *